US008032953B2

(12) United States Patent
Wilson et al.

(10) Patent No.: US 8,032,953 B2
(45) Date of Patent: Oct. 11, 2011

(54) LIQUID DISPENSING DEVICE

(75) Inventors: Brian Wilson, Norfolk (GB); Steve N. Balls, Norfolk (GB); Darren Smith, Thetford (GB); Peter Virica, Cambridge (GB)

(73) Assignee: Jeyes Group Limited, Thetford (GB)

( * ) Notice: Subject to any disclaimer, the term of this patent is extended or adjusted under 35 U.S.C. 154(b) by 1380 days.

(21) Appl. No.: 10/560,749

(22) PCT Filed: Jun. 16, 2004

(86) PCT No.: PCT/GB2004/002563

§ 371 (c)(1), (2), (4) Date: Oct. 3, 2006

(87) PCT Pub. No.: WO2004/113631

PCT Pub. Date: Dec. 29, 2004

(65) Prior Publication Data

US 2007/0151005 A1 Jul. 5, 2007

(30) Foreign Application Priority Data

Jun. 16, 2003 (GB) ..... 0313930.0

(51) Int. Cl.
*E03D 9/03* (2006.01)

(52) U.S. Cl. ..... 4/227.1; 4/227.2; 4/227.4; 4/227.6

(58) Field of Classification Search . 4/222, 227.1–227.7
See application file for complete search history.

(56) References Cited

U.S. PATENT DOCUMENTS

| | | | |
|---|---|---|---|
| 3,023,426 | A | 3/1962 | Neal |
| 3,698,021 | A | 10/1972 | Mack et al. |
| 3,841,524 | A | 10/1974 | Easter |
| 4,285,074 | A | 8/1981 | Leinberry |
| 4,346,483 | A | 8/1982 | Rosen et al. |
| 4,429,809 | A | 2/1984 | Bousgarbies |
| 4,915,260 | A | 4/1990 | Jones |
| 4,949,403 | A | 8/1990 | LoMaglio |
| 5,429,270 | A | 7/1995 | Tumminia |
| 5,488,742 | A | 2/1996 | Liao |
| 5,774,903 | A | 7/1998 | Wilson et al. |
| 5,839,128 | A | 11/1998 | Wang |
| 6,055,679 | A | 5/2000 | Goelz et al. |

(Continued)

FOREIGN PATENT DOCUMENTS

| | | |
|---|---|---|
| DE | 299 21 111 | 6/2000 |

(Continued)

*Primary Examiner* — Tuan Nguyen

(74) *Attorney, Agent, or Firm* — Dickstein Shapiro LLP

(57) ABSTRACT

A liquid dispensing device for use in the flush cistern of a water closet comprises a reservoir (13) for the liquid formulation which is fed from an inverted container (5) maintaining a constant liquid level (47) in the reservoir (13) at the mouth (37) of the container. A displacement body in the form of a piston (9), which may be magnetic, moves in a bore (56) to dispense liquid through opening (25). The piston (9) is moved by a float (11) which moves up and down as the level of water L in the cistern rises and falls on flushing. The float is coupled to the piston (9) magnetically. In another embodiment a direct mechanical coupling is used. Liquid seeps past piston (9) when in the lowered position, and is raised to overflow outlet (25) when the cistern fills. In another embodiment, liquid is dispensed on a downward stroke of the piston. The fit of piston (9) in the bore allows liquid to seep slowly past the piston to replenish the bore.

12 Claims, 9 Drawing Sheets

U.S. PATENT DOCUMENTS

| | | | |
|---|---|---|---|
| 6,212,692 | B1 | 4/2001 | Hu |
| 6,240,573 | B1 | 6/2001 | Tsai |
| 6,289,525 | B1 | 9/2001 | Prommer et al. |
| 6,496,987 | B1 | 12/2002 | Chou |
| 6,526,599 | B2 | 3/2003 | Benayahoo |
| 2002/0194671 | A1 | 12/2002 | Harbutt et al. |

FOREIGN PATENT DOCUMENTS

| | | | |
|---|---|---|---|
| DE | 100 45 455 | | 3/2002 |
| EP | 0 096 698 | | 12/1983 |
| EP | 0 182 671 | | 5/1986 |
| EP | 0 304 379 | | 2/1989 |
| EP | 0 528 073 | | 2/1993 |
| EP | 0 738 358 | | 10/1996 |
| EP | 0 962 601 | | 12/1999 |
| EP | 0 866 181 | | 2/2002 |
| FR | 2 572 749 | | 5/1986 |
| FR | 2 577 895 | | 8/1986 |
| FR | 2 819 279 | | 7/2002 |
| GB | 1 140 031 | | 1/1969 |
| GB | 2 086 844 | | 5/1982 |
| GB | 2 139 661 | | 11/1984 |
| GB | 2 123 047 | | 11/1985 |
| GB | 2 162 339 | | 1/1986 |
| GB | 2 167 041 | | 5/1986 |
| GB | 2 167 531 | | 5/1986 |
| GB | 2 195 368 | | 7/1988 |
| GB | 2 277 941 | | 11/1994 |
| GB | 2 291 895 | | 2/1996 |
| GB | 2 297 098 | | 7/1996 |
| GB | 2 298 878 | | 9/1996 |
| GB | 2 301 846 | | 12/1996 |
| GB | 2 356 851 | | 6/2001 |
| JP | 06136803 | A * | 5/1994 |
| WO | WO 90/10759 | | 9/1990 |
| WO | WO 95/19473 | | 7/1995 |
| WO | WO 96/27714 | | 9/1996 |
| WO | WO 01/96676 | | 12/2001 |
| WO | WO 02/079583 | | 10/2002 |
| WO | WO 02/092924 | | 11/2002 |
| WO | WO 03/033830 | | 4/2003 |

* cited by examiner

LIQUID DISPENSING DEVICE

This invention relates to a liquid dispensing device, and particularly to a device for delivering a liquid formulation to the flush cistern of a water closet for onward delivery to a lavatory bowl. Such formulations will typically include constituents such as fragrance, colourant, disinfectant, bleach, limescale remover or surfactant, or a combination of these. The formulation may be in the form of a solution, dispersion or suspension.

It has been known for a long time to provide so-called toilet automatics in the form of a solid or semi-solid product, a 'rim block', to be mounted within the inner rim of a water closet bowl where the flushing water will wash over the product and thereby dissolve or erode it to release active constituents into the water flow. Blocks may also be placed on top of the cistern in Japanese style systems where water from a tap flows over the block and then into the cistern for subsequent delivery to the toilet bowl when the toilet is flushed, and blocks may also be placed within the cistern below the water level, where the block slowly releases constituents into the water.

These products have long been used to deliver a surfactant, a perfume and/or a dye to the toilet bowl. The surfactant provides a cleaning action, whilst the dye and perfume provide a visual and olfactory indication to the user that some cleansing effect is being achieved. Much effort has also been put into formulating rim blocks which will also deliver a bleaching agent, such as sodium dichloroisocyanurate, to the toilet bowl and these have been successfully developed and marketed by the present applicants. More recently, 'liquid rim' devices for dosing a liquid formulation into the toilet bowl have been developed, the device being suspended from the rim of the bowl or for placement on the cistern of a Japanese style system.

Many different mechanisms have been proposed for dosing solid or liquid formulations into the flush cistern of a water closet or urinal. For example, as mentioned above, a solid block of low solubility may be completely immersed in the water of the flush cistern, slowly dissolving in the water of the flush cistern. This has the disadvantage that the concentration of the active constituents in the water of the flush cistern will depend of the interval between consecutive flushes of the flush cistern, so that if the concentration is too weak the product will be not be sufficiently effective and if the concentration is too strong then a wasteful amount of active constituents will be used.

Other proposals have been made which dose a quantity of a liquid formulation into the flush cistern as it empties or refills. Some proposed devices use a siphoning operation to dispense the liquid formulation from a reservoir containing the liquid formulation into the flush cistern via a tube which descends below the level of the water of the flush cistern. When the flush cistern empties, the water level drops and a reduced pressure is produced in the siphonic tube which will draw some of the liquid formulation from the reservoir to the water in the flush cistern. Examples can be seen in GB-A-2065738, WO-A-4212098, DE-A-3728126.

Another device uses a pivot technique to dip a scoop into a reservoir of liquid formulation and deliver the contents of the scoop into the water of the flush cistern. Such devices use the rising and falling water level in the flush cistern to move a float which is pivotally connected to the scoop. Examples can be seen in GB-A-2295834, WO95/04868, U.S. Pat. No. 2,021,110.

Another common proposal is a double ended valve stem which is mounted on a float and seals an outlet at the bottom of a reservoir. As the valve moves between two extreme positions, as the cistern empties and fills, a dose of liquid leaks past the valve into the cistern. Examples can be seen in GB-A-1140031, GB-A-2086844, GB-A-2298878 and WO 02/092924.

Many devices generally suffer from being too complex to manufacture cheaply, often requiring several moving parts, or from an uncertain dosing regime whereby it is difficult to deliver an even dose of the liquid formulation over the lifetime of the product. Other problems arise from the surprising difficulty of installing such devices in a flush cistern because of space constraints, the lid design for such flush cisterns and the problem of mounting the device in the cistern.

Thus, despite the many devices proposed in the patent literature, there is still a need for a device which will dose a liquid formulation in discrete amounts into a flush cistern over a prolonged period of time.

One aim of the present invention is to provide a liquid dispensing device for use in the flush cistern of a water closet, which automatically dispenses a dose of a liquid formulation into the flush cistern each time the flush cistern is discharged and refilled.

Another aim is to provide a liquid dispensing device which is mechanically simple and which is compact so as to fit easily in a cistern.

Another aim of the invention is to provide a manner of suspending a dispensing device in the flush cistern.

According to one aspect of the invention, a liquid dispensing device comprises a liquid formulation, a reservoir for the liquid formulation, means for maintaining the level of the liquid formulation in the reservoir at a predetermined level, an outlet through which the liquid formulation can be dispensed, and means for dispensing a quantity of the liquid formulation via the outlet, wherein the means for dispensing a quantity of the liquid formulation via the outlet comprises means for temporarily increasing the level of the liquid formulation in the reservoir so that the liquid formulation enters the outlet.

The liquid formulation may contain one or more of a surfactant, dye, bleach, limescale remover, perfume or disinfectant and may be in the form of a solution, dispersion or suspension.

One means for maintaining the level of the formulation in the reservoir at a predetermined level is to feed liquid into the reservoir via a conduit whose open lower end is sealed by the liquid in the reservoir when the liquid reaches the desired level, preventing air from travelling back up the conduit. The conduit is fed from an otherwise sealed container so that a reduced pressure is created in the container as liquid continues to flow when the conduit outlet is sealed against ingress of air, preventing further flow of the liquid. In one embodiment we provide an inverted container of liquid immediately above the reservoir. The mouth of the container extends into the reservoir, thus forming the conduit, and liquid will flow into the reservoir until the level of the liquid formulation in the reservoir covers the mouth of the container. The container rests on a stop, to set the mouth of the container at a predetermined level which will in turn set the level of the liquid in the filled reservoir. The general operation of such devices is well known and can be seen in WO01/132995 for example. The container may be replaceable, providing a refill for the device.

The means for raising the level of the liquid formulation in the reservoir, so as to overflow through the outlet, may be a displacement body which moves within the reservoir. Movement of the body raises the level of the liquid, for example by upward movement to raise a layer of formulation above the body, or downward movement into the formulation to displace the formulation.

Preferably, the means for dispensing a quantity of the liquid formulation is automatically initiated, in use, by movement of the water of the flush cistern as the water level in the cistern falls or rises as the cistern empties or fills. Therefore, each time the flush cistern undergoes a discharge and refill cycle, a dose of the liquid formulation will be dispensed into the water in the flush cistern.

Various means may be provided to move the displacement body. A float, which rises and falls with the water level in a cistern, may coupled to the displacement body to move it. In one embodiment the means, such as a float, for moving the displacement body is not mechanically coupled to the displacement body. One means for non-mechanically coupling the float to the displacement body is a magnetic force.

In one embodiment the displacement body is weighted or its density is greater than that of the liquid formulation so that the displacement body tends to sink in the liquid formulation to a first position where the displacement body is below the surface of the liquid formulation so that there is a film of liquid formulation above the displacement body. When the displacement body is moved upwards from the first position to the second position it lifts this film of liquid formulation to the level of an outlet and a quantity of the liquid formulation is thus dispensed via the outlet.

In one embodiment, the displacement body is the movable core of a solenoid. The body incorporates a magnetic material and the means for moving the displacement body comprises an electromagnetic coil disposed around the body. When the electromagnetic coil is energised, by passing a current through it, the displacement body moves in the magnetic filed created by the coil and displaces the liquid formulation, as described above. The electromagnetic coil may be energised automatically when the flush cistern is discharged or refilled using an appropriate switching mechanism, or it may be initiated manually by operating a switch. In another embodiment, the electromagnetic coil may normally be energised automatically and a manual override may be used when multiple doses are desired. The coil may be energised from a small cell, such as a button cell. The actuation of the device may also be triggered by a sensor which detects the change in water level in the cistern when it is flushed.

In another embodiment, the displacement body includes a magnet and the means for moving the displacement body comprises a movable member which carries another magnet. The movable member may be connected to the liquid dispensing device by a guide. In one embodiment the guide is below the reservoir.

Preferably the movable member floats in water, so that when water is discharged from the flush cistern, the movable member falls and when the flush cistern is refilled the movable member rises with the rising water level. The movement of the movable member up and down serves to move the displacement body through the action of the magnetic force between the respective magnets. The buoyancy of the movable member is sufficient to actuate the dispensing device but preferably will not cause the device to float.

The use of magnets to couple the displacement body to the movable member is a mechanically elegant method of coupling as it eliminates the need for any direct physical coupling, and minimises the number of parts in the device.

In one embodiment, the density of the displacement body is greater than the density of the liquid formulation. The magnets within the displacement body and movable member are oriented to repel each other. Between flushes, when the device is in its static mode, the movable member is buoyed by the water in the flush cistern and is in its upper position. Consequently the displacement body is raised to its upper (second) position by the repulsive force between the respective magnets. The combined buoyancy forces and the repulsive force between the magnets is greater than the apparent weight of the displacement body so as to lift and maintain the displacement body in its raised second position. When the water in the flush cistern is discharged, the movable member descends. When the movable member has descended sufficiently so that the combined buoyant force and reduced repulsive force is less that the weight of the displacement body, the displacement body, which is denser than the liquid formulation, moves downwards to its first position and is fully submerged beneath the liquid formulation.

When the flush cistern is refilled, the movable member is lifted and the combined buoyant force and magnetic repulsive force raises the displacement body from its first (lower) position to its second (upper) position. The upward movement of the displacement body temporarily raises the level of the liquid formulation located above the displacement body, to a level above the reservoir outlet. An amount of the liquid formulation is dispensed via the outlet into the water in the flush cistern. The displacement body rests in this position until the next flush cycle is initiated. When the displacement body is in the form of a piston moving in a cylinder or housing, the amount of liquid above the piston, and hence the amount dispensed from the reservoir, can be reproduced within a tolerable degree over the lifetime of the dispenser container or refill. This is because the reservoir is replenished from the container to maintain the liquid level in the reservoir substantially constant (there will typically be some variation in the liquid level about a mean as the container mouth is covered and uncovered).

In another embodiment, the magnetic piston is held in a raised position when the float is raised, with the cistern full. As the cistern empties the float falls and allows the piston to fall, and liquid is dispensed on the falling stroke of the piston.

In another embodiment, the displacement body is coupled mechanically to a float which is raised and lowered by the water in the cistern as the cistern fills and empties.

Particularly when the displacement body is in the form of a piston, by tailoring the viscosity of the liquid formulation and the gap between the displacement body and the adjacent reservoir walls, it is possible to ensure that the liquid is carried or pushed up by the displacement body, to flow out of the outlet, and liquid can subsequently seep into the space above or below the displacement body in between flushes.

Preferably a piston moves in a piston housing forming part of or being in liquid communication with the reservoir.

An outlet for liquid to be dispensed into the cistern from the reservoir may be located at an upper end of the piston housing. The piston housing may be refilled by the liquid formulation seeping into a lower end of the housing and up past the piston, or seeping through an aperture near the upper end of the housing above the piston. In the latter case, the inlet to the piston housing may be smaller than the outlet aperture to ensure that the liquid will exit the outlet rather than move back through the aperture.

In another embodiment, the piston pumps liquid from the container on a downward stroke of the piston, a conduit feeding liquid from the piston housing to the dispenser outlet.

As liquid is dispensed from the reservoir, the level falls and it is replenished automatically to maintain the liquid level substantially constant, for example by using a constant head device as described above.

Another aspect of the invention provides a dispensing device for dispensing liquid into a toilet cistern, the device comprising a piston housing, a piston movable in the housing to pump liquid from the housing, a float coupled to the piston and positioned, in use, to be raised and lowered by the water in the cistern as the water level changes, the float causing movement of the piston to pump liquid from the housing.

In one embodiment the piston pumps liquid from the housing as the float falls, in another embodiment the piston pumps liquid from the housing as the float rises.

The piston housing may be replenished from a reservoir. The reservoir may incorporate a constant head device for maintaining a substantially constant level of liquid in the reservoir. The reservoir may feed liquid into the piston housing through a space between the piston and the housing wall.

According to another aspect of the invention, a dispensing device has a strap for suspending the dispensing device inside the lidded flush cistern of a water closet. The strap is in the form of a thin, flexible ribbon which will sit easily between an upper edge of the cistern body and the cistern lid. The strap is attached at one end to the cleansing device and at the other end to the outer surface of the flush cistern, or otherwise locked in place so that the weight of the dispensing device does not pull the strap into the cistern. The strap is sufficiently thin and flexible so that in use it does not substantially raise the lid of the flush cistern.

Preferably the width of the strap is between 5 mm and 40 mm. More preferably, the width of the strap is between 10 mm and 20 mm.

Preferably the thickness of the strap is less than 1 mm. Textile ribbon provides a suitable material for the strap.

Preferably, the outer edge of the strap is attached to the flush cistern by a suction pad or an adhesive. In another embodiment a cord stopper may be used, the stopper being position on the strap outside the cistern and preventing the strap being pulled between the cistern lid and cistern wall and into the cistern by the weight of the dispenser.

By using a strap, i.e. something having appreciable width, any tendency of the device to swing across the face of the cistern wall is reduced.

Other aspects and preferred features of the invention will be apparent from the following description and the accompanying claims.

The invention will be further described by way of example only, with reference to the accompanying drawings, in which.

Figure 1:
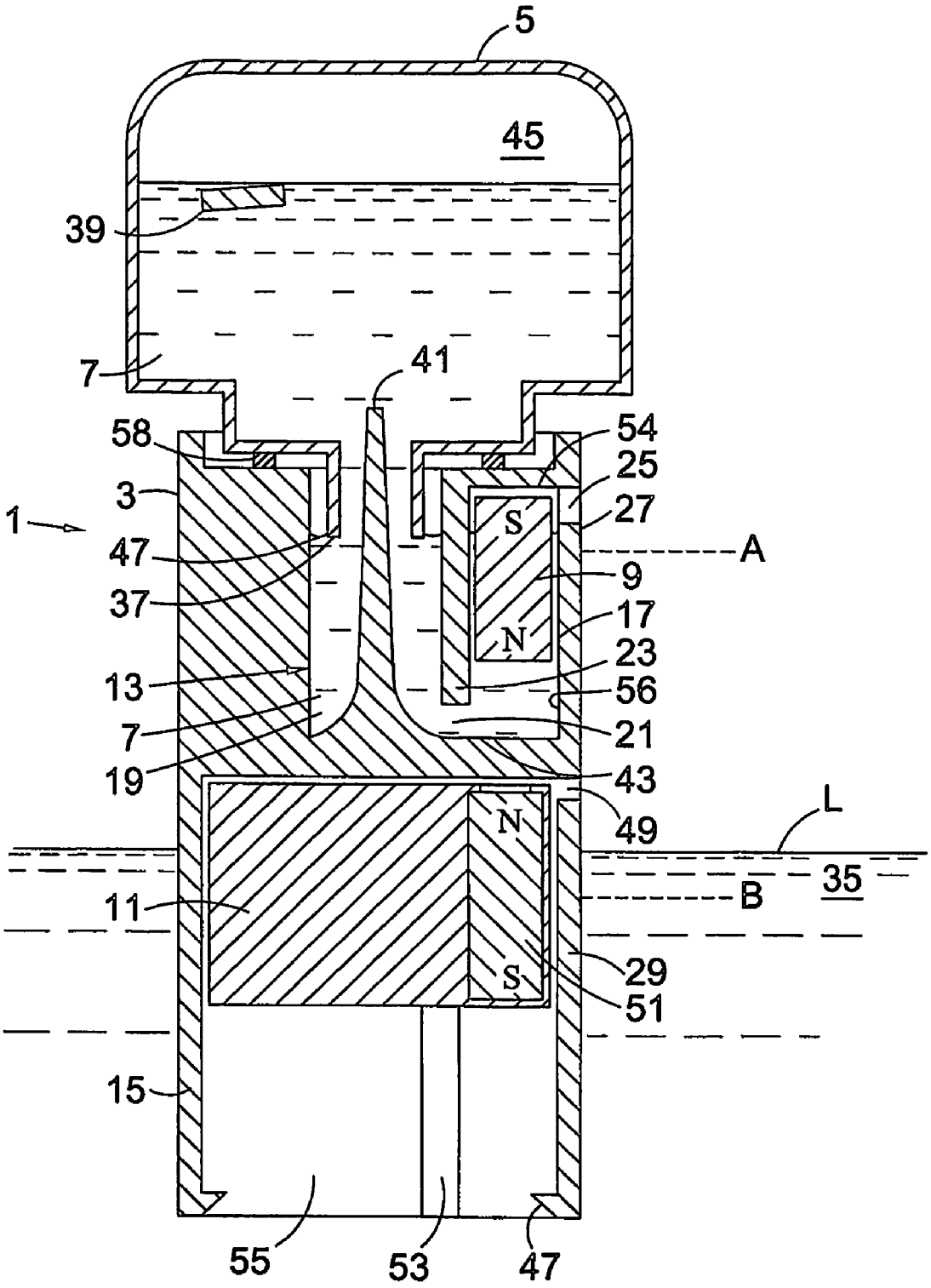
FIG. 1 is a vertical cross section view of a liquid dispensing device suspended in a cistern and between flushes of the cistern, with a container or refill cartridge attached, along line I-I of FIG. 4.

In the embodiment of FIGS. 1 to 5, a liquid dispensing device 1 comprises a main body 3, a refill container 5 containing liquid formulation 7, a displacement body in the form of a piston 9 and a movable member 11 which, in use, causes movement of the displacement body 9.

The main body 3 has a reservoir 13 positioned above a guide chamber 15. Reservoir 13 is in two parts, a cup like inlet region 19 and a piston housing 17. The piston housing 17 is in liquid communication with the inlet region 19 via a piston housing inlet 21. The piston housing 17 is separated from the inlet region by a wall 23. An outlet 25 is provided at the upper end 27 of the piston housing 17. The reservoir 13, in use, contains the liquid formulation 7 ready for dispensing.

An outer wall 29 of the lower guide chamber 15 forms a guide for the movable member 11.

Figure 7:
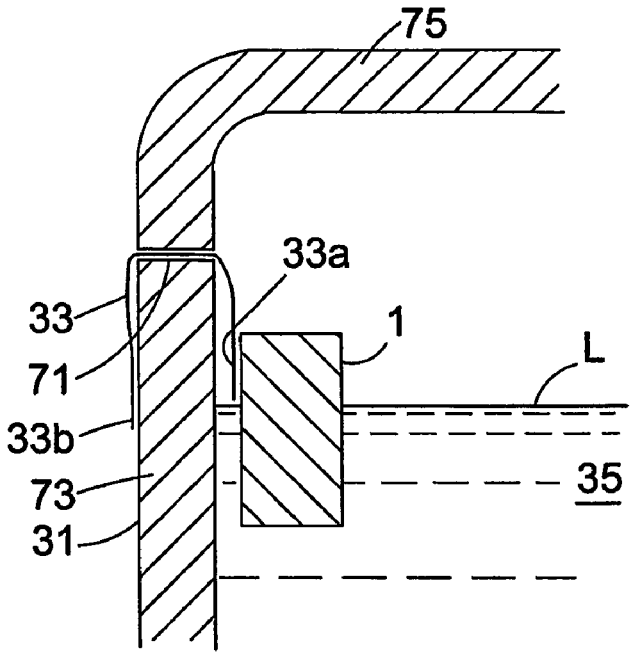
FIG. 7 illustrates a third embodiment of the invention.

In use, liquid dispensing device 1 is mounted inside a flush cistern 31 (see FIG. 7). A strap 33 (see FIG. 7) suspends the liquid dispensing device 1 in the cistern 31. The liquid dispensing device 1 is positioned in the flush cistern so that when the water level L of the flush cistern is at its highest (between flushes), the liquid dispensing device is partially submerged in the water 35 of the flush cistern so that the buoyant movable member 11 is at the top of its travel but the reservoir outlet 25 is not submerged, i.e. the water level is generally between levels A and B shown in FIG. 1.

The refill container 5 is inverted so that its mouth 37 faces downwards and is positioned in the reservoir 23. When the refill container 5 is mounted on the reservoir 13, a seal 39 of the refill container is broken by a vertical spike 41 which extends up from base 43 of the reservoir 13. In practice seal 39 is part of a cylindrical cap provided on the mouth of container 5 as seen in the embodiment of FIGS. 12 to 15, and also as seen in WO 01/32295 for example. This mechanism for opening the mouth of the refill container 5 as it is installed on the body 3 is well known in the art of liquid rim devices. It will be appreciated that when we refer to a refill container 5 we also include a container 5 which is provided for the first use of the device.

Figure 2:
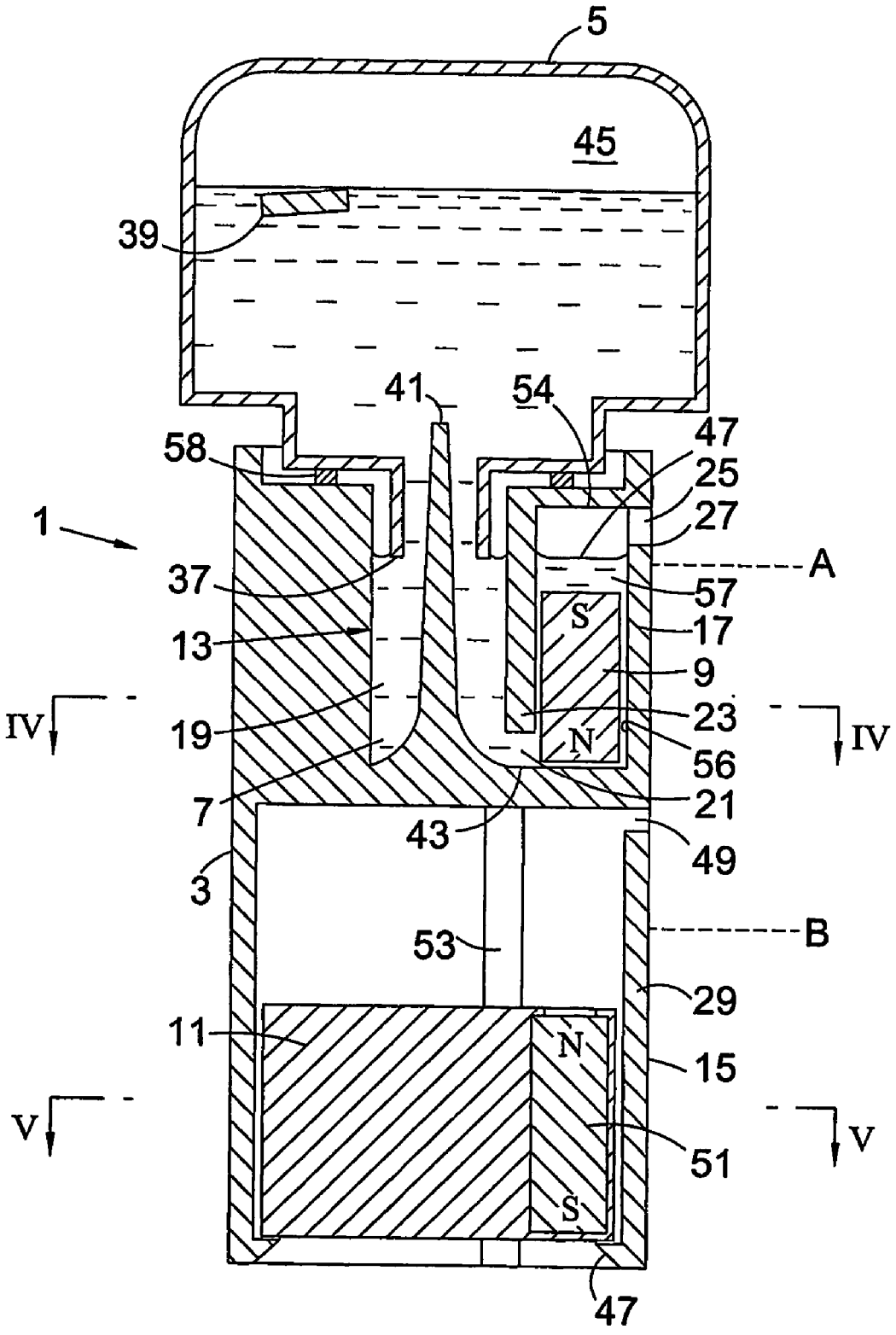
FIG. 2 is a cross section view of the liquid dispensing device when the flush cistern is being discharged.

The piston housing 17 houses the piston 9 which moves vertically within the piston housing 17 between an upper position (FIG. 1) and a lower position (FIG. 2).

In use, the liquid formulation 7 flows through the mouth 37 of the refill container 5 into the reservoir 13 while air flows in the opposite direction into the refill container 5 to collect at the uppermost region 45. The level of the liquid formulation 7 in the reservoir 13 and the piston housing 17 rises until the liquid level covers the mouth 37 of the refill container 5. At this point air is unable to enter the refill container 5, and so the flow of the liquid formulation 7 from the refill container 5 into the reservoir 13 is arrested because further flow of liquid into the reservoir creates a reduced pressure in the space 45. In this manner, the level 47 of the liquid formulation 7 in the reservoir 13 is substantially maintained at a predetermined level close to the level of the mouth 37.

Figure 5:
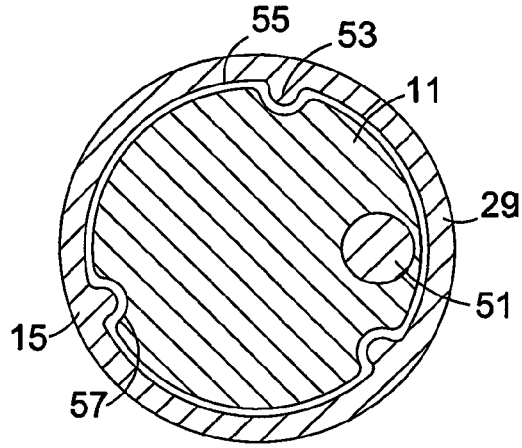
FIG. 5 is a cross section along line V-V of FIG. 2.

The movable member 11 is located in the guide chamber 15. The movable member 11 is cylindrical and is less dense than water so that it is buoyed by the water 35 in the flush cistern. The guide chamber 15 within which the movable member 11 is housed is also cylindrical and sufficient clearance is provided around the movable member 11 so that the movable member 11 can move freely up and down within the guide 15. Referring to FIG. 5, axially extending guide rails 53 on the inner surface 55 of the chamber 15 cooperate with grooves 57 in the outer surface of the movable member 11 to fix the orientation of the cylindrical member 11 with the magnet 51 aligned below the piston 9. There is a lower opening 47 at the base of the guide 15 to allow ingress of water when the flush cistern fills with water. An upper opening 49 in the upper part of the guide 15 allows the outflow of air when water enters the opening 47 at the base of the guide 15. Similarly when the cistern is emptied, water drains through lower opening 47, air being sucked in through upper opening 49.

The piston 9 is comprised of a cylindrical magnet that is oriented vertically with its poles N,S at the respective upper and lower ends of the cylinder. The movable member 11 contains a similar magnet 51 which is also oriented vertically. The magnet 51 in the movable member 11 is substantially in line with the piston 9. The two magnets 9, 51 are relatively oriented so that they will repel one another.

The density of the piston 9 is greater than the density of the liquid formulation 7 so that it will tend to sink in the formulation. Conversely, magnet 51 is embedded in a less dense plastics body 52 so that the movable member 11 floats in water as described above.

The operation of the device will now be described with reference to FIGS. 1 to 3. Between flushes, when the liquid dispensing device 1 is in a static mode, the movable member 11 will be buoyed by the water 35 in the flush cistern and will be in its upper position shown in FIG. 1. Consequently the magnet piston 9 is repelled by the magnet 51 and so raised to its upper (second) position. In order for the piston 9 to be held in its upper position, the buoyancy forces and the repulsive force between the magnets 9, 51 must be greater than the apparent weight of the piston 9 so as to lift and maintain the piston 9 in its raised second position. In practice, piston 9 may abut the upper end 54 of the piston housing, which limits the travel of the piston. When the water 35 in the flush cistern is discharged, the movable member 11 will descend in the guide 15. When the movable member 11 has descended sufficiently, the piston 9 drops downwards to its lower (first) position, shown in FIG. 2, submerged beneath the liquid formulation 4. In FIG. 2, liquid 7 has seeped between the piston 9 and the wall 56 of the housing 17 to reach the level 47, providing a layer of liquid 57 above the piston. The clearance C provided between the piston 9 and the piston housing wall 56 is tailored to meet a number of criteria, and will depend also on the viscosity of the formulation, as will be described hereinafter.

Figure 3:
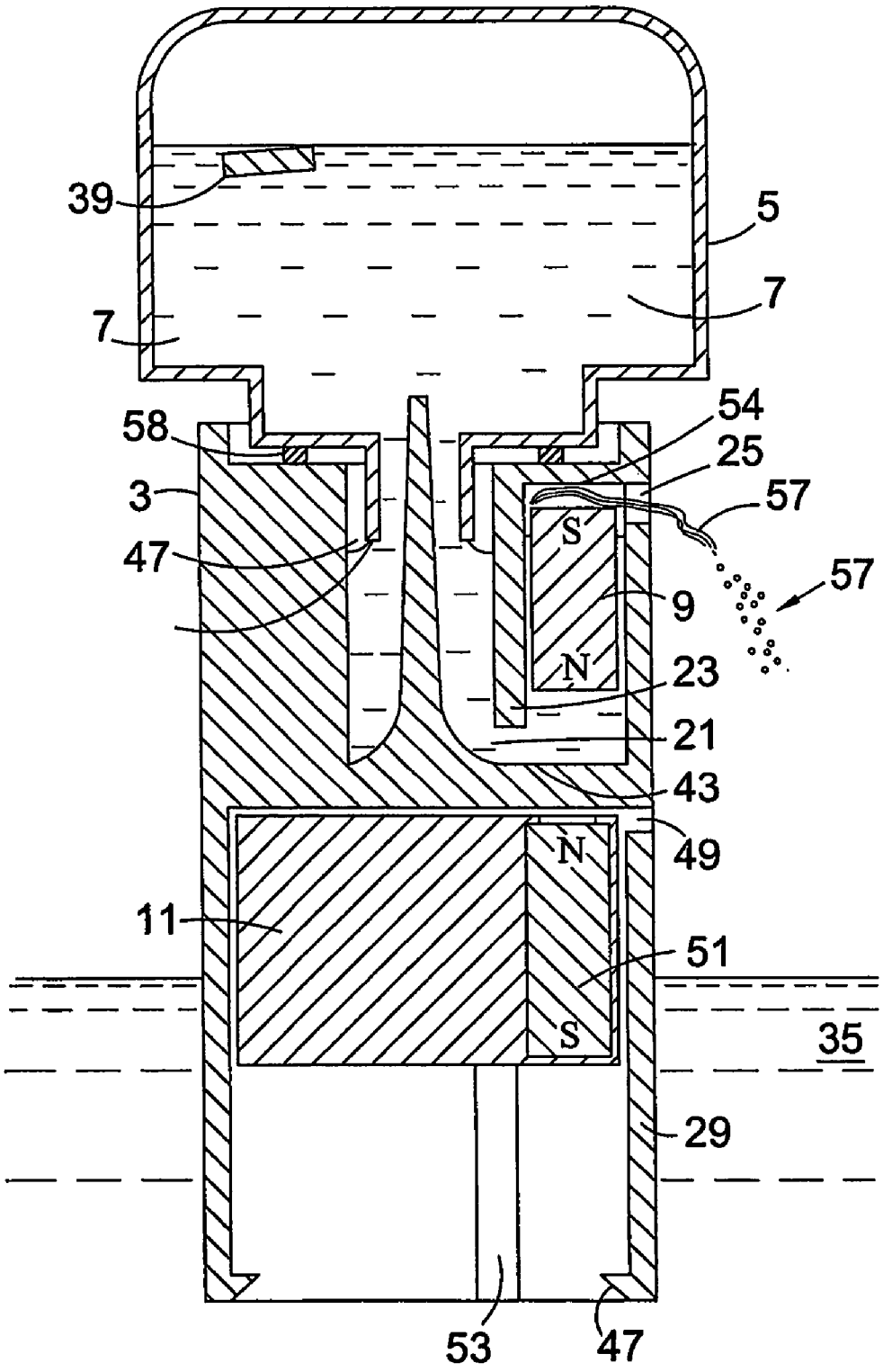
FIG. 3 is a cross section view of the liquid dispensing device when the flush cistern is filling up and when the liquid formulation is being ejected from the device.
Figure 4:
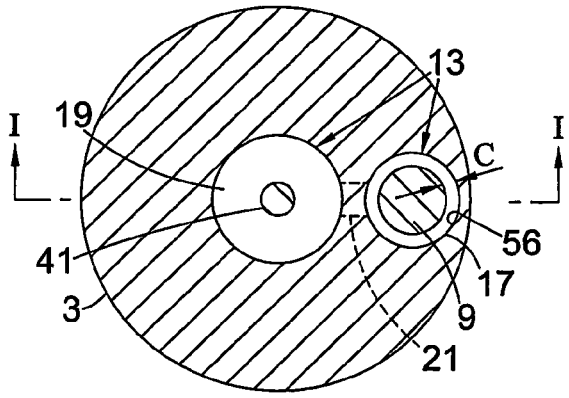
FIG. 4 is a cross section along line IV-IV of FIG. 2.

FIG. 3 shows the state of the liquid dispensing device 1 when the water in the flush cistern is just reaching its upper level. The movable member 11 is lifted and the magnetic repulsive force causes the piston 9 to rise from its first (lower) position to its second (upper) position. The relatively rapid movement of the piston 9 raises the level 47 of the liquid formulation 7 in the piston housing 17, i.e. the liquid layer 57 above the piston 9, and the layer 57 is thus overflows the outlet 25 to be dispensed into the water in the flush cistern. It will be appreciated that the movement of piston 9 provides a pumping action to raise the layer 57, causing it to flow out through outlet 25. The liquid dispensing device 1 may rest in this static mode until the next flush cycle is initiated.

As the piston 9 rises in the piston housing 17, it needs to lift the layer of formulation above it, thus clearance C (FIG. 4) between the piston 9 and the wall of the housing 17 should be small enough to prevent a significant proportion of liquid formulation draining back down past the piston 9 into the lower part of the housing 17. Also, housing inlet 21 is large enough to allow liquid to flow easily into the base of the housing 17 from inlet region 19. Conversely, when the piston has fallen back to its lower position, FIG. 2, in the time interval when the cistern is emptying and refilling, clearance C must be large enough to allow formulation 7 to seep upwards to form the layer 57 above the piston during this time interval. This re-charging time interval will be substantially longer than the time taken for the movable member to rise in the guide 15 near the end of cistern filling cycle. As indicated above, the clearance C will depend in part on the viscosity of the formulation.

As liquid is dispensed from the device through outlet 25, the level 47 will fall until the mouth 37 of the container 5 is exposed, allowing air to enter the container and liquid to flow again into the reservoir 13 until the liquid level 47 again covers the mouth of the container. It will be appreciated that several doses of liquid may be dispensed before the mouth 37 is uncovered and the reservoir may replenish to a level slightly above mouth 37. Thus, within an acceptable tolerance the position of the container mouth 47 serves to set the normal level of the liquid in the reservoir, and the level of the mouth 37 is controlled by supporting the container on supports 58 on the body 3. The supports also provide a space between the refill container 5 and the body 3 for air to enter the reservoir 13 around the neck of the container 5.

The dosing volume, i.e. the volume of liquid dosed into the cistern at each flushing operation, is approximately equal to the layer of the liquid 57, and so determined by the liquid level 47 and the height or length of the magnet 9. A dosing volume of about 0.1 $cm^3$ is preferred, with a likely variation of ±0.05 $cm^3$. This allows for about 400 doses from a 40 $cm^3$ container 5.

The magnet piston 9 is of corrosion resistant material. Typical dimensions for the material are about 5 mm diameter, 12 mm long, with the piston housing having a diameter of about 5.3 mm to provide clearance C.

The viscosity of the formulation is typically between 10 and 1000 mPas, more typically a few hundred mPas, between 100 and 500, measured in a Brookfield viscometer, spindle No. 6 at 25° C.

It is possible to provide two containers 5, dosing into one reservoir 13. The containers may hold formulations which are incompatible for long term shelf storage, such as bleach and colourant, but can be mixed in use. Also, two reservoirs could be used with respective containers and respective displacement bodies to maintain complete separation until liquid is dosed into the cistern.

Figure 6:
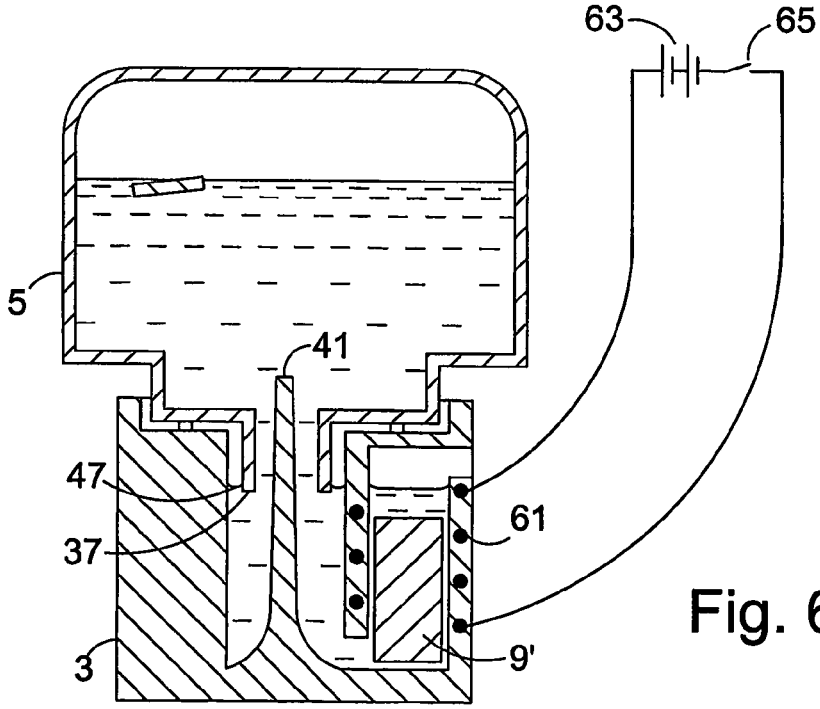
FIG. 6 shows a second embodiment of the invention in a view similar to that of FIG. 1.

Referring to FIG. 6, it is also possible to actuate piston 9 electrically. Piston 9 is formed of magnetic material, such as iron (in which case it can be coated with plastics material to prevent corrosion) and is surrounded by a coil 61 to form a solenoid. Coil 61 is connected to a button cell 63 via a switch 65. When switch 65 is closed, current flows through the coil, driving the piston 9 upwards. The switch 65 may be positioned outside the cistern for manual actuation, but it could also be triggered by the mechanical action of flushing the cistern, or by a sensor which detects the change in level of water in the cistern as the cistern is flushed and refilled. The sensor could be mounted on the lower end of the body 3, along with the switch 65 and button cell 63, to provide a unitary package.

Figure 8:
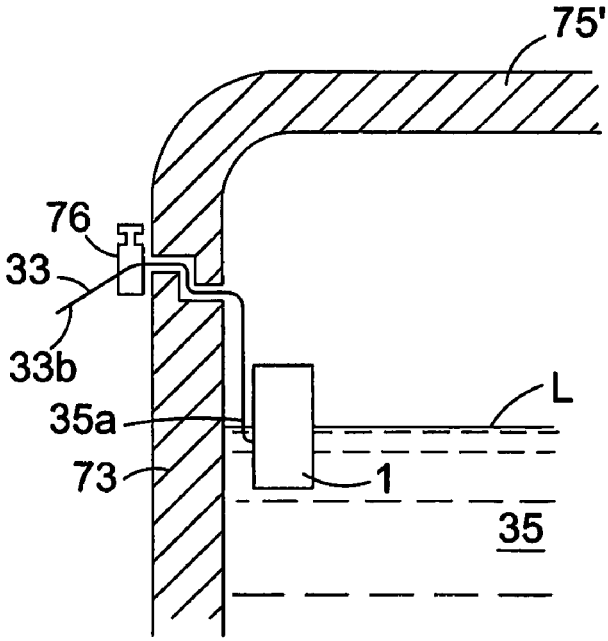
FIG. 8 shows a modification of the embodiment of FIG. 7.

Referring again to FIG. 7, the dispensing device 1 is supported in the cistern 31 by a strap 33 attached at, one end 33 a to the dispenser body 3. Strap 33 is ribbon like, and preferably formed of textile material. The strap is flexible to enable it to follow the contour of the upper edge 71 of the cistern wall 73 and is also thin, so that it sits easily between the cistern wall and the lid 75 without significantly disturbing the fit of the lid. By providing a strap of significant width, the strap will help resist any tendency of the body 3 to swing sideways (out of the plane of the drawing) in the cistern as the water level rises about the body. The outer end 33*b* of the strap is attached to the cistern wall by a sucker, but a releasable glue pad could be used, for example. Also, referring to FIG. 8, an adjustable cord stopper or toggle 76 could be provided on the free end 33*b* of the strap 33 to sit against the junction between the lid and wall 73, thus carrying the weight of the dispenser by preventing the strap being pulled between the cistern wall and the cistern lid.

Figure 9:
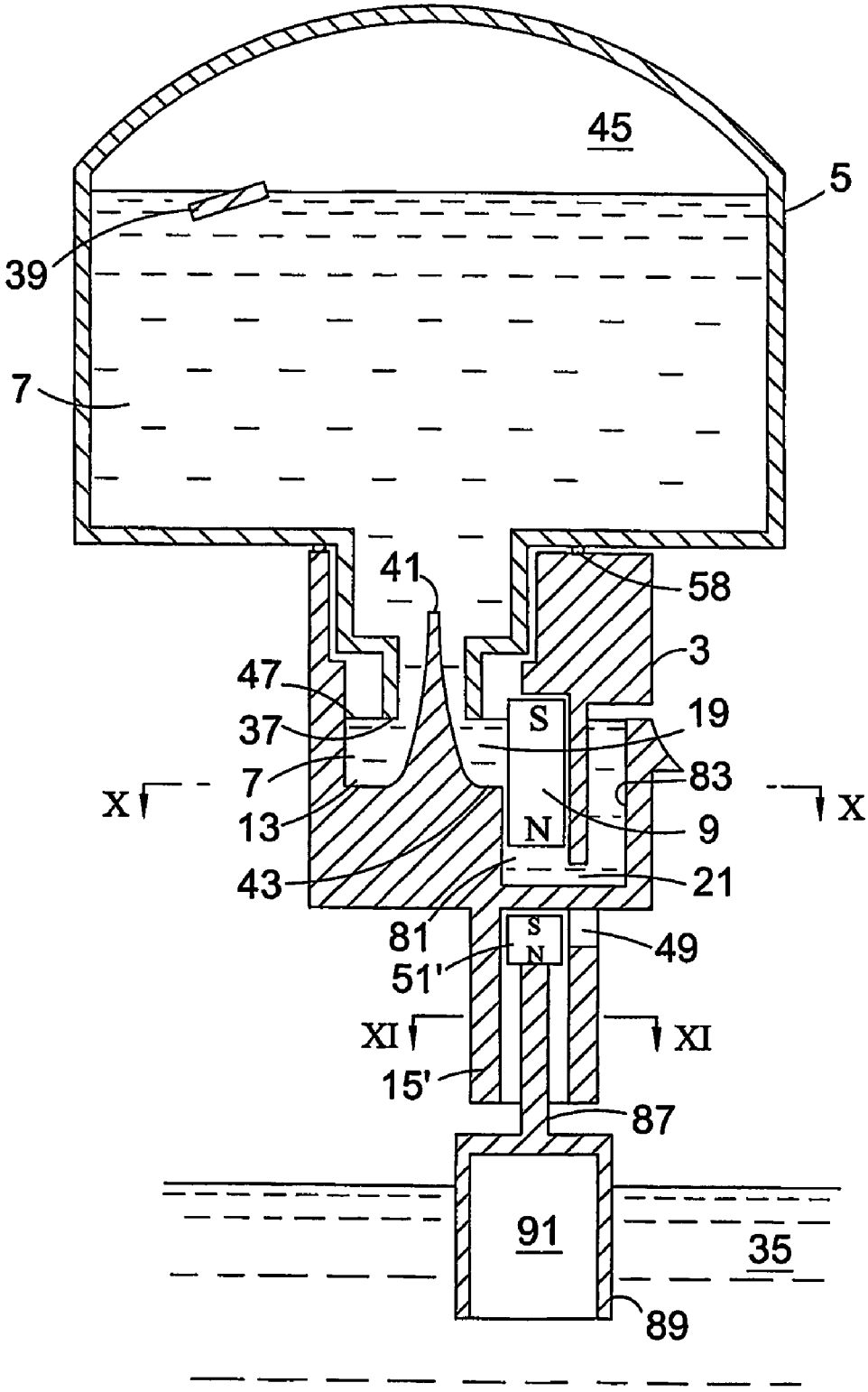
FIG. 9 shows a vertical cross-section through a fourth embodiment of the invention, similar to the view of FIG. 1, and taken along line XI-XI of FIG. 10.
Figure 10:
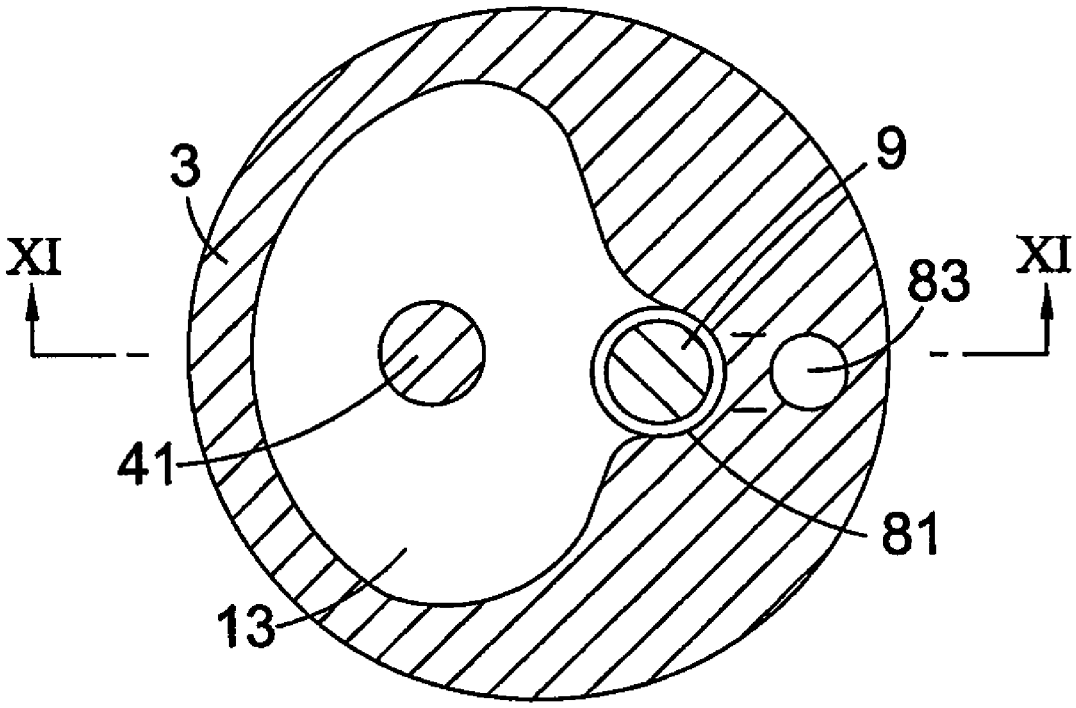
FIG. 10 is a cross-section along the line X-X of FIG. 9.
Figure 11:
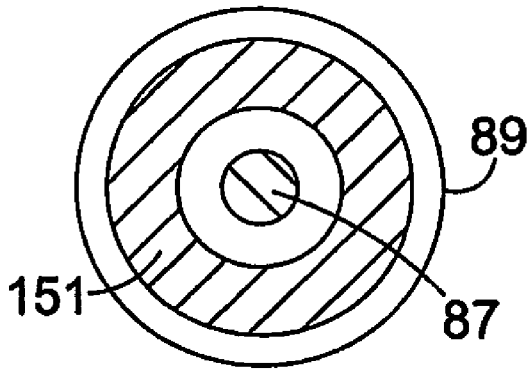
FIG. 11 is a cross-section along line XI-XI of FIG. 9.

The embodiment of FIGS. 9, 10 and 11 is similar to the embodiment of FIGS. 1 to 5 and like parts are given like reference numerals. The embodiment of FIGS. 9 to 11 uses a magnetically actuated piston or pump type mechanism, however in this embodiment the downward stroke of the displacement body or piston 9 raises the level of the liquid 7 in the reservoir 13 to overflow the outlet 25.

Displacement body 9 is in the form of a vertically oriented cylindrical magnet which is guided at its lower end in a cylindrical bore 81 in the base 43 of the reservoir 13. The lower end of the bore 81 has a through passage 21 which connects with a parallel bore 83 leading up to outlet 25.

To cause movement of magnet 9, a magnet 51' is guided in a guide chamber 15'. Magnet 51' is mounted on a pin 87 of an inverted cup shaped float 89.

FIG. 9 shows the dispensing device 1 in use with the cistern filled, i.e. with the water level high and the inverted cup shaped float 89 raised. The dispenser is positioned so that the level of water 35 in the cistern is somewhere between the bottom end of the cup 89 in its raised position and the outlet 25. Cup 89 floats because air is trapped in space 91 as the water level rises. With the cup 89 in the raised position, magnet 51' is at the top of the guide chamber 15' and is oriented to repel magnet 9, raising magnet 9 in the bore 81. When the cistern is flushed, the level of water 35 falls, causing float 89 to fall and so lowering magnet 51' to the bottom of the guide chamber 15'. This allows magnet 9 to fall. Magnet 9 is a close fit in bore 81, similar to the fit of magnet 9 in piston housing 17 of the embodiment of FIGS. 1 to 5. As magnet 9 falls it pumps liquid 7 from the lower end of bore 81 through passage 21, so that the liquid level in bore 83 is raised to overflow outlet 25.

Subsequently, when the cistern refills, magnet 9 is raised to the position shown in FIG. 9, and liquid seeps past magnet 9 from inlet region 19 into the bottom of the bore 81 and the bore 83 to equalise the liquid level across the reservoir 13, ready for the next dispensing stroke when the cistern is flushed.

FIGS. 12 to 15 show an embodiment of a liquid dispensing device 1 which operates in a similar manner to the device of FIGS. 9 to 11, with a downward piston stroke pumping liquid from the reservoir, but in this case the float is mechanically coupled direct to the piston, rather than using a magnetic force.

Figure 12:
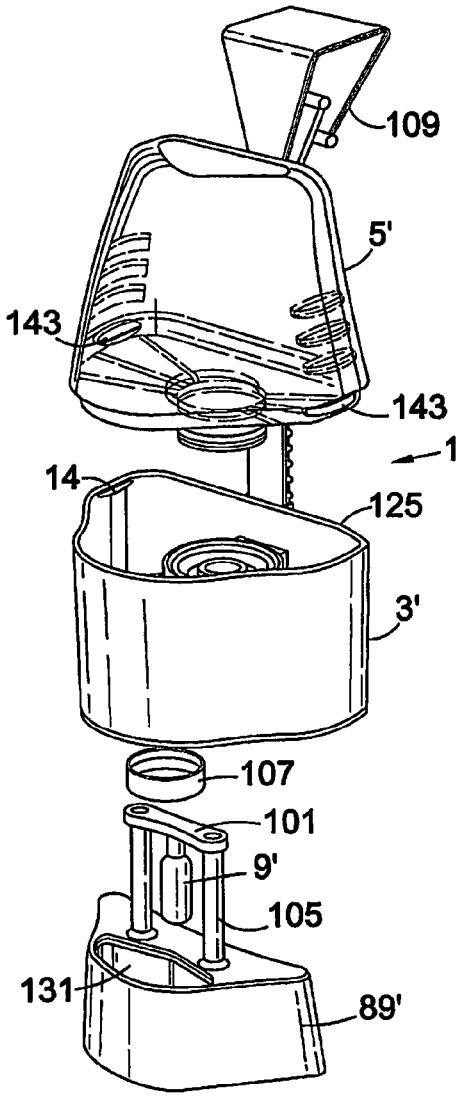
FIG. 12 is an exploded perspective view of a fifth embodiment of the invention.

FIG. 12 shows an exploded view with a container 5', a body 3' and a float 89'. A piston 9' is of plastics material and depends down from a bridge piece 101 which is supported on float 89' by legs 105. A cap 107 is also shown and the purpose of cap 107 will be described hereinafter together with the structure of a strap 109 which suspends the body 3 inside a cistern. Container 5', strap 109, body 3' and float 89' are moulded of plastics material, as is typical in the art.

Figure 13:
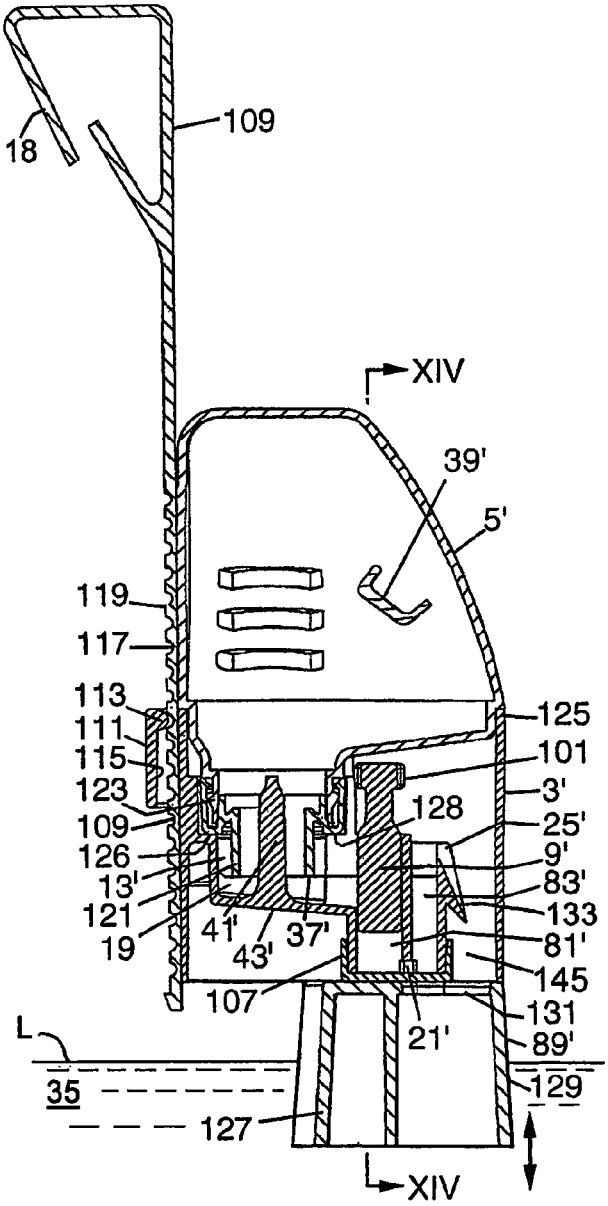
FIG. 13 is a vertical cross section through the embodiment of FIG. 12, assembled, along line XIII-XIII of FIG. 14.
Figure 14:
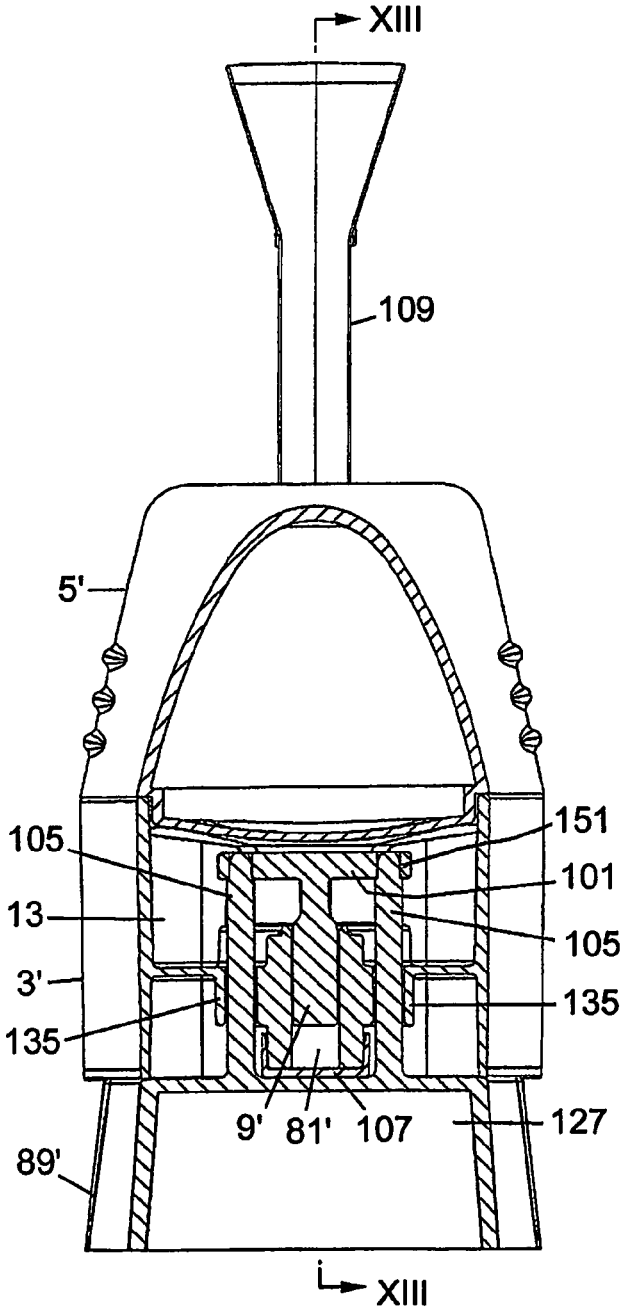
FIG. 14 is a cross-section on line XVI-XVI of FIG. 13.
Figure 15:
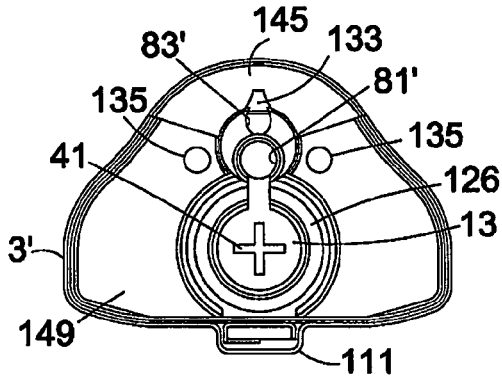
FIG. 15 is a plan view of the body of the embodiment of FIG. 12.

FIG. 13 is a vertical cross-section of the assembled device in side view. Strap 109 is coupled to body 3' by a ratchet mechanism to enable the user to adjust the position of the body 3' along the strap 109, and hence the height of the device in the cistern. Strap 109 fits in a collar 111 on body 3' and a nib 113 on the inner face 115 of collar 111 engages selectively in one of a plurality of grooves 117 on the facing surface 119 of strap 109. Collar 113 is resilient to allow strap 109 to be pulled through. The upper end of strap 109 has a hook 118 for hooking over the upper edge of the cistern wall.

Body 3' is a generally hollow moulding but similar in function to body 3 of the embodiment of FIGS. 9 to 11. Body 3' defines a reservoir 13' having a spigot 41' extending up from the base 43' of the reservoir and a cylindrical bore 81' extending downwards to one side of the reservoir 13'. Cylindrical piston 9' is received in the bore 81'.

Container 5' has a cylindrical closure 121 on a mouth 123. Closure 121 has a frangible seal 39' which has been displaced by spigot 41'. Closure 121 has a lower mouth 37' which defines the level of liquid in the reservoir 13'. Container 5' rests on an outer rim 125 of the body 3' and a shoulder 126 at the upper part of reservoir 13' so as to fix the container in place and so determine reasonably accurately the position of the lower edge 37' of the container outlet and the liquid level in the reservoir 13'. The container 5 is a snap fit onto the body 3', by means of detents 141 and recesses 143 (FIG. 12).

Bore 81' connects with an upright bore 83' via a through passage 21'. To facilitate moulding, the bottom wall of bores 81', 83' is formed by cap 107. Cap 107 may be a tight fit or glued or welded in place on assembly.

Float 89' has an inverted cup portion 127 which in use traps air when the cistern water level rises, to provide buoyancy. An adjacent portion 129 of float 89' has an opening 131 which aligns with an opening 145 in a base 149 of body 3'. Portion 129 provides an aesthetically pleasing shape to match body 3' but also provides an enclosed path to the flush water for dispensed liquid. Outlet 25' is formed above a lip or spout 133 which serves to guide the dispensed liquid which overflows outlet 25'.

To assemble the device, piston 9' is inserted in bore 81' with collar 101 attached to the upper end on piston 9'. Support pins or legs 105, on float 89' are inserted upward through sleeved apertures 135 (FIGS. 14, 15) in the base 149 of body 3' and snap into receiving holes 151 in the collar 101.

The operation is similar to the embodiment of FIGS. 9 to 11, save that the piston 9' is directly coupled to the float 89'.

FIG. 13 shows the dispensing device 1 in use with the cistern filled, i.e. with the water level high and the float 89' raised because air is trapped in cup portion 127. The dispenser is positioned so that the level of water 35 in the cistern is somewhere between the bottom end of the cup 89' in its raised position and the bottom of body 3'. This can be readily done by the used when installing the device. With the float 89' in the raised position, piston 9' is raised in the bore 81'. When the cistern is flushed, the level of water 35 falls, causing float 89' to fall and so piston 9'. Piston 9' is a close fit in bore 81, as for the fit of piston 9 in piston housing 17 of the embodiment of FIGS. 1 to 5. As piston 9 falls it pumps liquid 7 from the lower end of bore 81' through passage 21, so that the liquid level in bore 83' is raised to overflow outlet 25'.

Subsequently, when the cistern refills, piston 9 is raised to the position shown in FIG. 13, and liquid seeps past piston 9 from the inlet region of the reservoir 13' into the bottom of the bore 81' and the bore 83' to equalise the liquid level across the reservoir 13', ready for the next dispensing stroke when the cistern is flushed.

The invention claimed is:

1. A liquid dispensing device for use in the flush cistern of a water closet, the device comprising: a liquid formulation, a reservoir for the liquid formulation, means for maintaining the level of the liquid formulation in the reservoir at a predetermined level, an outlet through which the liquid formulation is dispensed, and means for dispensing a quantity of the liquid formulation via the outlet, wherein the means for dispensing a quantity of the liquid formulation via the outlet comprises means for temporarily increasing the level of the liquid formulation in the reservoir so that the liquid formulation enters the outlet, wherein the means for temporarily increasing the level of the liquid formulation in the reservoir comprises a displacement body which is movable between a first position and a second position, and means is provided for magnetically moving the displacement body from the first position to the second position to dispense a quantity of the liquid formulation from the reservoir via the outlet, wherein the means for magnetically moving the displacement body includes a movable member substantially aligned with the displacement body, the displacement body comprising a first vertically oriented magnet and the movable member comprising a second vertically oriented magnet, the first vertically oriented magnet and the second vertically oriented magnet configured to repel each other, and wherein the displacement body has a density greater than the density of the liquid formulation such that it sinks, and the movable member is embedded in a plastics body which is less dense than the liquid formulation such that it floats.

2. A liquid dispensing device as claimed in claim 1, wherein the means for dispensing a quantity of liquid formulation is actuated, in use, by the change in water level of the flush cistern when it is actuated.

3. A liquid dispensing device as claimed in claim 1, wherein a piston housing is disposed within the reservoir, and the displacement body is housed within the piston housing to form a piston.

4. A liquid dispensing device as claimed in claim 3, wherein the fit of the piston in the housing allows the piston to pump liquid from the housing when it is moved from the first position to the second position, and liquid can seep past the piston in the housing when it is stationary.

5. A liquid dispensing device as claimed in claim 4, in which the piston pumps liquid from the housing as the movable member falls.

6. A liquid dispensing device as claimed in claim 4, comprising a reservoir for the liquid and in which piston housing is replenished from the reservoir.

7. A liquid dispensing device as claimed in claim 6, in which the reservoir is fed from a supply of the liquid and a constant head device is provided for maintaining a substantially constant level of liquid in the reservoir.

8. A liquid dispensing device as claimed in claim 6, in which the reservoir feeds liquid into the piston housing through a space between the piston and the housing wall.

9. A dispensing device comprising a strap for suspending the device in a toilet cistern, a container of liquid, a displacement body housing a magnetically movable piston in a piston chamber, the piston chamber having an outlet for liquid to be pumped from the device by movement of the piston, a conduit for supplying liquid from the container to the piston chamber, and means is provided to magnetically move the displacement body to pump a quantity of liquid from the device, wherein the means for magnetically moving the displacement body includes a movable member substantially aligned with the displacement body, the displacement body comprising a first vertically oriented magnet and the movable member comprising a second vertically oriented magnet, the first vertically oriented magnet and the second vertically oriented magnet configured to repel each other, and wherein the displacement body has a density greater than the density of the liquid such that it sinks, and the movable member is embedded in a plastics body which is less dense than the liquid such that it floats.

10. A dispensing device as claimed in claim 9, wherein the conduit includes a reservoir for the liquid, the container of liquid is positioned above the reservoir and feeds liquid into the reservoir via a constant head device which maintains, in use, a substantially constant level of liquid in the reservoir.

11. A dispensing device as claimed in claim 10, wherein the movable member is positioned, in use, below the piston, whereby the piston is raised by the rise of water in the cistern, and the piston is lowered by the downward movement of the movable member as the water falls, the piston chamber is provided at the lower end of the piston chamber and the liquid is pumped from the chamber through the chamber outlet as the piston is lowered.

12. A dispensing device as claimed in claim 11, wherein the chamber outlet is fluidly connected with an upwardly extending bore having an outlet at an upper end thereof, and liquid is pumped through said bore and over said outlet.

* * * * *